US009266339B2

(12) United States Patent
Toda

(10) Patent No.: US 9,266,339 B2
(45) Date of Patent: Feb. 23, 2016

(54) PRINTING ELEMENT SUBSTRATE, LIQUID EJECTION HEAD AND INKJET PRINTING APPARATUS

(71) Applicant: CANON KABUSHIKI KAISHA, Tokyo (JP)

(72) Inventor: Kyosuke Toda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/557,645

(22) Filed: Dec. 2, 2014

(65) Prior Publication Data

US 2015/0165779 A1 Jun. 18, 2015

(30) Foreign Application Priority Data

Dec. 17, 2013 (JP) ..... 2013-260518
Oct. 31, 2014 (JP) ..... 2014-222786

(51) Int. Cl.
*B41J 2/165* (2006.01)
*B41J 2/19* (2006.01)
*B41J 2/175* (2006.01)

(52) U.S. Cl.
CPC ..... *B41J 2/17513* (2013.01); *B41J 2/165* (2013.01); *B41J 2/19* (2013.01); *B41J 2202/07* (2013.01); *B41J 2202/22* (2013.01)

(58) Field of Classification Search
CPC .. B41J 2/14032; B41J 2/1601; B41J 2202/07; B41J 2202/11
See application file for complete search history.

(56) References Cited

U.S. PATENT DOCUMENTS

2005/0208208 A1* 9/2005 Kuriki et al. ..... 427/100
2011/0027530 A1* 2/2011 Ushijima et al. ..... 428/138

FOREIGN PATENT DOCUMENTS

JP 4-250046 A 9/1992
JP 2000-177119 A 6/2000
JP 2007-269016 A 10/2007

* cited by examiner

*Primary Examiner* — Kristal Feggins
*Assistant Examiner* — Kendrick Liu
(74) *Attorney, Agent, or Firm* — Fitzpatrick, Cella, Harper & Scinto

(57) ABSTRACT

A recessed portion is provided on a shorter side of a rectangular liquid supply passage. Thereby a flow pathway by the recessed portion can be ensured, and even in a case where the air bubble is trapped to be closer to and in contact with one end of the liquid supply passage, a difference in flow resistance to two ink flows generated in this state can be made small. In this way, the flow speeds of the inks flowing in the periphery of the air bubble can be made small as a whole, and as a result, it is possible to suppress an ejection failure due to transfer of the air bubble to the ejection opening side or the like.

8 Claims, 9 Drawing Sheets

PRINTING ELEMENT SUBSTRATE, LIQUID EJECTION HEAD AND INKJET PRINTING APPARATUS

BACKGROUND OF THE INVENTION

1. Field of the Invention

The present invention relates to a printing element substrate, a liquid ejection head, and an inkjet printing apparatus, and, in particular, to the configuration of a liquid supply hole that is provided in a substrate of a liquid ejection head that ejects a liquid such as ink.

2. Description of the Related Art

A liquid ejection head such as a printing head that is used in an inkjet printing apparatus, for supplying a liquid to liquid ejection portions that are provided on one side of a substrate, adopts a system in which a through hole (liquid supply hole or liquid supply passage) is provided in the substrate to supply the liquid from the opposite surface of the substrate, for example. Japanese Patent Laid-Open No. 2007-269016 describes the configuration of the liquid supply hole provided in the substrate of the liquid ejection head, in which a sectional area of the liquid supply hole increases in the supply direction of the liquid and after that, decreases. This configuration will hereinafter be also referred to as "rhomboid configuration". Since the liquid supply hole is formed in the rhomboid configuration, a size of the printing element substrate, particularly a size in the width direction can be made small to downsize the liquid ejection head or it is possible to suppress the liquid ejection head from being large in size due to an increase in kind of the liquid.

On the other hand, however, in a case of the liquid ejection head having a rhomboid supply passage configuration, there occurs a problem that air bubbles generated in the liquid tend to be easily accumulated in this rhomboid section, and thereby flow of the liquid to be supplied is interrupted to cause an ejection failure in the liquid ejection head. To deal with this problem, Japanese Patent Laid-Open No. 2000-177119 describes a method for making air bubbles retained in an end region away from an ink supply hole to avoid an ejection failure. In addition, Japanese Patent Laid-Open No. H04-250046(1992) describes the construction in which a sectional configuration of an ink supply hole is formed on a polygonal shape such as a rectangular shape or a groove is formed in the periphery of the ink supply hole, thus ensuring liquid flow in the liquid supply passage with the corners or the groove even when air bubbles are retained in the liquid supply passage.

However, in a case of adopting the method for providing the air bubble retention area to suppress the ejection failure as described in Japanese Patent Laid-Open No. 2000-177119, the suppression effect can be expected in a case where a size of the air bubble is small, but in a case where a relatively large air bubble is retained in the liquid supply hole, even when the air bubble is introduced to the retention area, in some cases apart of the air bubble possibly interrupts the flow of the liquid.

In many cases a sectional configuration of the liquid supply passage in a direction perpendicular to the liquid supply direction is rectangular as described in (FIG. 1 of) Japanese Patent Laid-Open No. 2007-269016. In this case, even when the air bubble is retained in the supply hole, the liquid flow in the flow passage can be ensured by the corner section of the rectangular shape as described in Japanese Patent Laid-Open No. H04-250046 (1992). However, in a case where the air bubble is retained to be closer to one side of the rectangular shape and therefore do not close the entire cross section, there are some cases where there occurs a difference in flow speed between the section not closed and the corner section at the time of supplying the liquid. The difference in flow speed causes the air bubble to move to the liquid ejection portion side, from which a problem of closing an inlet of the ejection portion is derived, for example.

SUMMARY OF THE INVENTION

The object of the present invention is to provide a printing element substrate, a liquid ejection head, and an inkjet printing apparatus that can ensure a liquid flow in a liquid supply passage regardless of presence of a retained air bubble therein, and can reduce a difference in speed of liquids to be supplied between supply paths.

In a first aspect of the present invention, there is provided a printing element substrate in which an ejection opening for ejecting a liquid is provided, wherein the printing element substrate is provided with a liquid supply passage that is formed along a direction from a surface of a substrate at the opposite to a surface thereof where the ejection opening is provided to the surface where the ejection opening is provided, the liquid supply passage being shaped such that an area of a cross section along a direction perpendicular to the direction to the surface where the ejection opening is provided increases and after that, decreases, in the direction to the surface where the ejection opening is provided, and the liquid supply passage has an opening end of a rectangular shape on the surface of the substrate at the opposite to the surface on the side where the ejection opening is provided, and a recessed portion, which has a certain depth in a direction toward the surface on the side where the ejection opening is provided, is formed on a shorter side in the rectangular shape.

In a second aspect of the present invention, there is provided a liquid ejection head comprising: a printing element substrate in which an ejection opening for ejecting a liquid is provided, the printing element substrate being provided with a liquid supply passage that is formed along a direction from a surface of a substrate at the opposite to a surface thereof where the ejection opening is provided to the surface where the ejection opening is provided, and the liquid supply passage being shaped such that an area of a cross section along a direction perpendicular to the direction to the surface where the ejection opening is provided increases and after that, decreases, in the direction to the surface where the ejection opening is provided, wherein the liquid supply passage has an opening end of a rectangular shape on the surface of the substrate at the opposite to the surface on the side where the ejection opening is provided, and a recessed portion, which has a certain depth in a direction toward the surface on the side where the ejection opening is provided, is formed on a shorter side in the rectangular shape.

In a third aspect of the present invention, there is provided a liquid ejection head comprising: a member including an ejection opening array in which ejection openings are arranged for ejecting a liquid; and a substrate including a first surface jointed to the member, a second surface as a backside of the first surface, and a liquid supply passage that establishes communication between the first surface and the second surface, the liquid supply passage including a part in which an area of a cross-section surface along the second surface increases in a first direction directed from the second surface to the first surface and a part in which the area decreases in the first direction and extending in a second direction along the ejection opening array, wherein a recessed portion having a certain depth in the first direction is formed on an end in the second direction of an opening of the liquid supply passage on the second surface.

According to the above configuration, the liquid flow in the liquid supply passage can be ensured regardless of the presence of retained air bubble in the liquid supply passage, and a difference in speed of liquids to be supplied between the supply paths can be reduced, thus suppressing an ejection failure of the liquid ejection head due to the movement of the air bubble.

Further features of the present invention will become apparent from the following description of exemplary embodiments (with reference to the attached drawings).

DESCRIPTION OF THE EMBODIMENTS

Hereinafter, embodiments of the present invention will be in detail explained with reference to the accompanying drawings.

Figure 1:
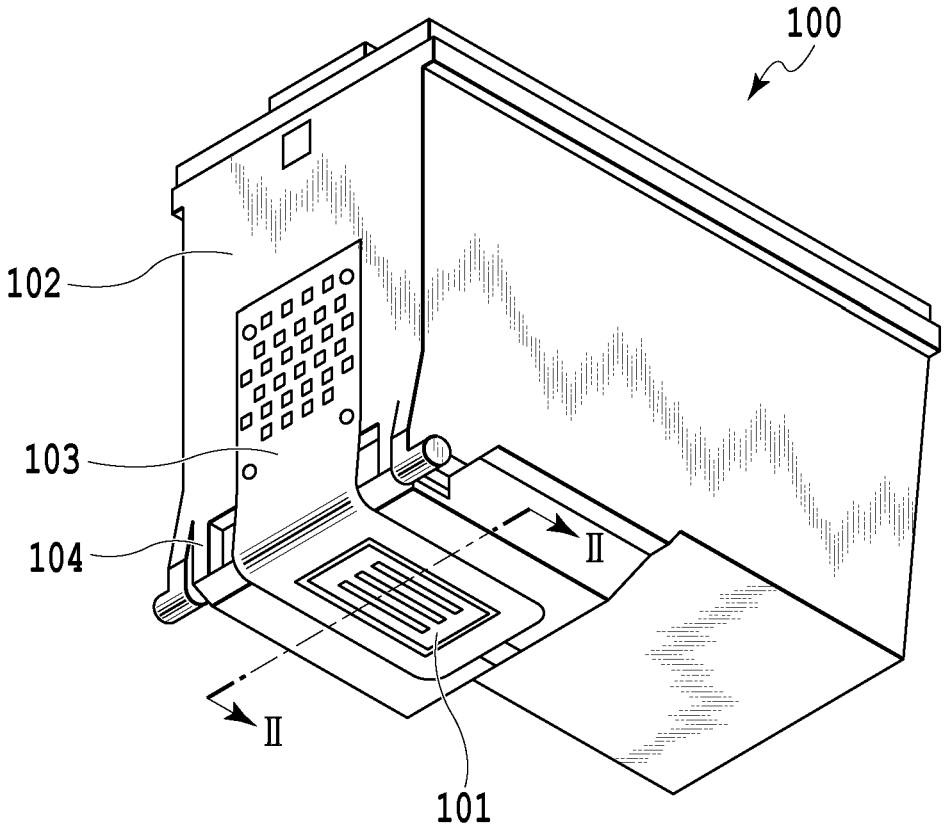
FIG. 1 is a perspective view showing an inkjet printing head according to an embodiment of a liquid ejection head in the present invention.

FIG. 1 is a perspective view showing an inkjet printing head according to an embodiment of a liquid ejection head in the present invention. In FIG. 1, a printing head in the present embodiment (hereinafter, also referred to as "liquid ejection head") 100 is configured to include a printing element substrate 101 and an ink storage portion 102 that accumulates ink to be ejected from the printing element substrate 101. Specifically, the printing element substrate 101 is provided with three ejection opening arrays in each of which a plurality of ejection openings are arranged for ejecting each of inks composed of cyan (C), magenta (M) and yellow (Y). The ink storage portion 102 is provided with storage parts that respectively accommodate the inks of C, M and Y. The printing element substrate 101 and the ink storage portion 102 are connected to each other through a support member 104 that is provided with ink passages between the ink storage portion 102 and the ejection openings of the printing element substrate 101. An electrical wiring board 103 is provided in the periphery of the printing element substrate 101 and apart of the ink storage portion 102, and therefore when the printing head is attached to the ink jet printing apparatus, an electrical connection can be established between an apparatus control unit and the printing head.

Next, an explanation will be made primarily of the configuration of the liquid supply hole (ink supply passage) in the printing head according to the conventional technology described in Japanese Patent Laid-Open No. 2007-269016 and the like, before explaining a liquid supply hole in the printing element substrate according to the embodiment in the present invention.

Figure 2:
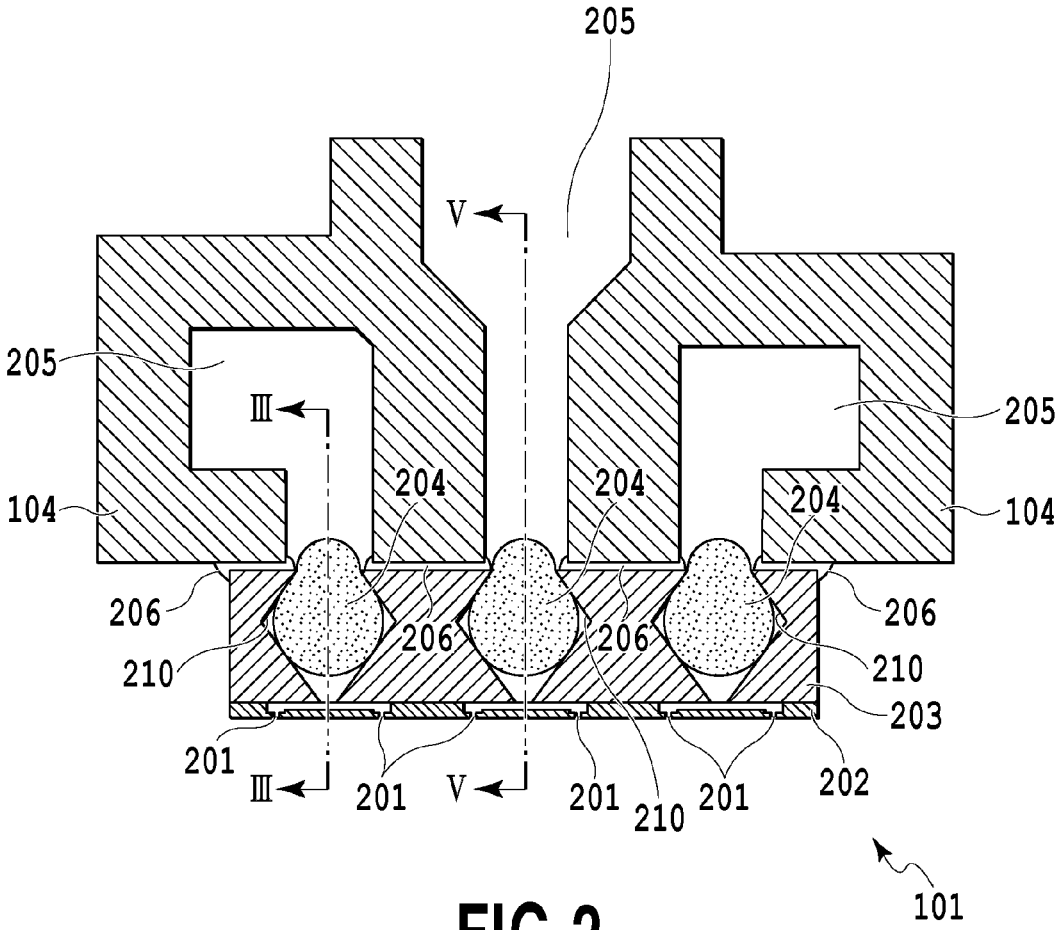
FIG. 2 is a cross sectional view showing primarily the configuration of a printing element substrate in a liquid ejection head according to the conventional technology.

FIG. 2 is a cross sectional view showing primarily the configuration of a printing element substrate in a liquid ejection head according to the conventional technology, for example, as shown in Japanese Patent Laid-Open No. 2007-269016, and shows a cross section taken along lines II-II in FIG. 1 (configuration different from a sectional configuration of the embodiment in the present invention). As shown in FIG. 2, the printing element substrate 101 is configured to include a substrate 203 and an ejection opening forming member 202. In the substrate 203, liquid supply passages 210 each of which is a through hole and has a cross section in a rhomboid configuration are formed. Specifically, the liquid supply passage 210 is formed in a direction from a surface of the substrate 203 at the opposite to a surface thereof where the ejection openings 201 are provided to the surface of the substrate 203 where the ejection openings 201 are provided. The liquid supply passage 210 is configured such that an area of a cross section along a direction perpendicular to the direction to the surface of the substrate 203 where the ejection openings 201 are provided increases toward the direction to the surface where the ejection openings 201 are provided and after that, decreases toward the same direction. In the ejection opening forming member 202, the aforementioned ejection openings (nozzles) 201 are formed, and a heater (ejection energy generating element; not shown) for generating thermal energy used in ejection is provided on a surface of the substrate 203 opposing the ejection opening 201. The printing element substrate 101 configured as above is jointed to the support member 204 of the printing head by an adhesive agent 206. Ink flow passages 205 respectively for inks of C, M and Y are provided inside the support member 104, and are communicated with ink storage portions corresponding thereto.

As shown in FIG. 2, there are some cases where air bubbles existing in the vicinity of the ejection opening 201 or in an ink supply system such as the liquid supply hole 210 and the ink flow passage 205 get together or grow to be formed as a relatively large air bubble 204, which is trapped in the liquid supply passage 210. This is because a relationship between surface tension and buoyancy force of the air bubble 204 act in a direction where the air bubble 204 is trapped by a gradually widening shape of the liquid supply hole 210 as viewed from the ink flow passage 205-side. When a large amount of ink is ejected by high-frequency drive in a state where the relatively large air bubble 204 is being trapped, as described later in FIG. 3 to FIG. 5 there are some cases where the air bubble 204 in the liquid supply hole 210 is pulled in to the ejection opening 201 side to cause an ejection failure.

Figure 3:
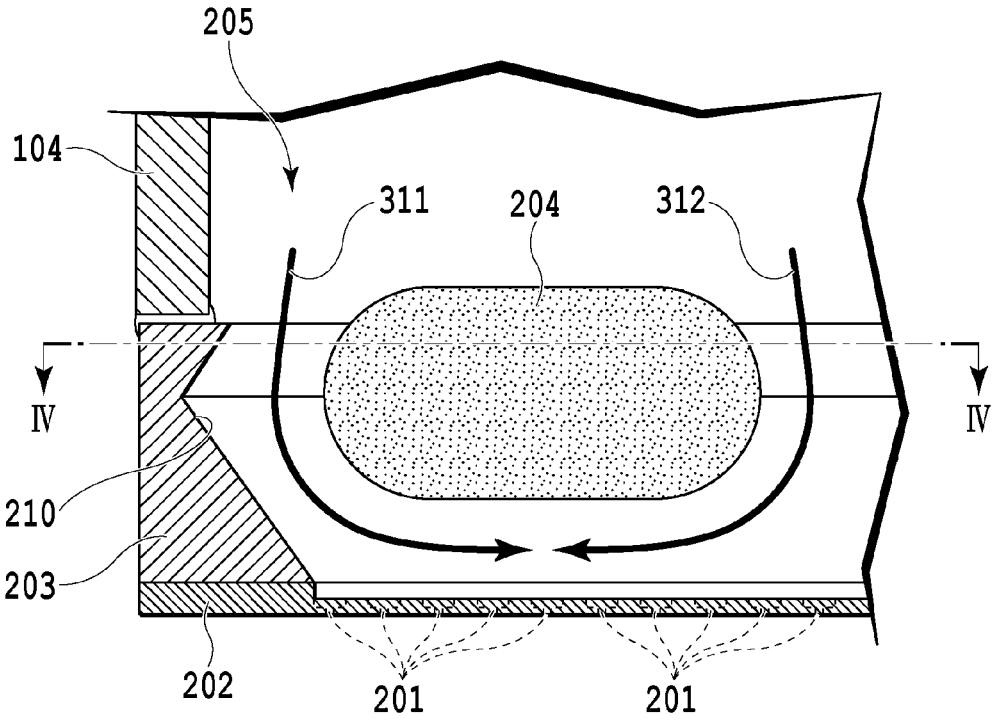
FIG. 3 is a cross sectional view showing III-III section in FIG. 2.
Figure 4:
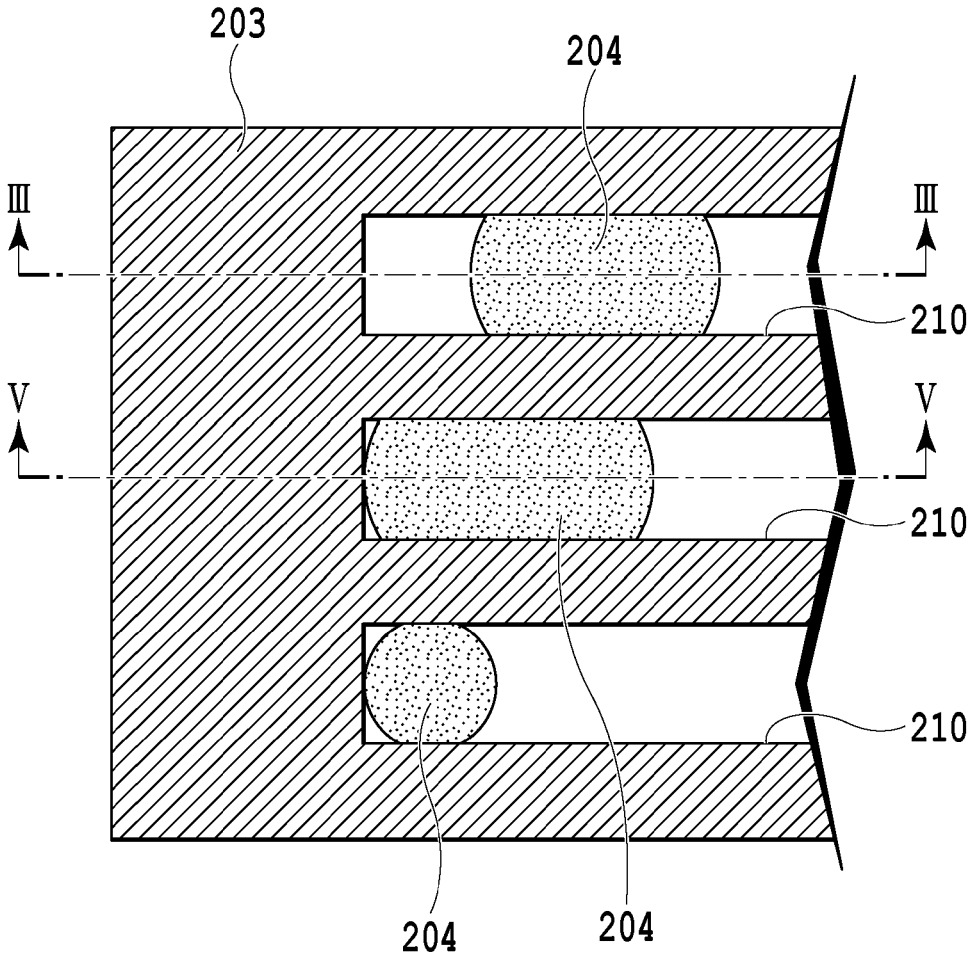
FIG. 4 is a cross sectional view showing IV-IV section in FIG. 3.
Figure 5:
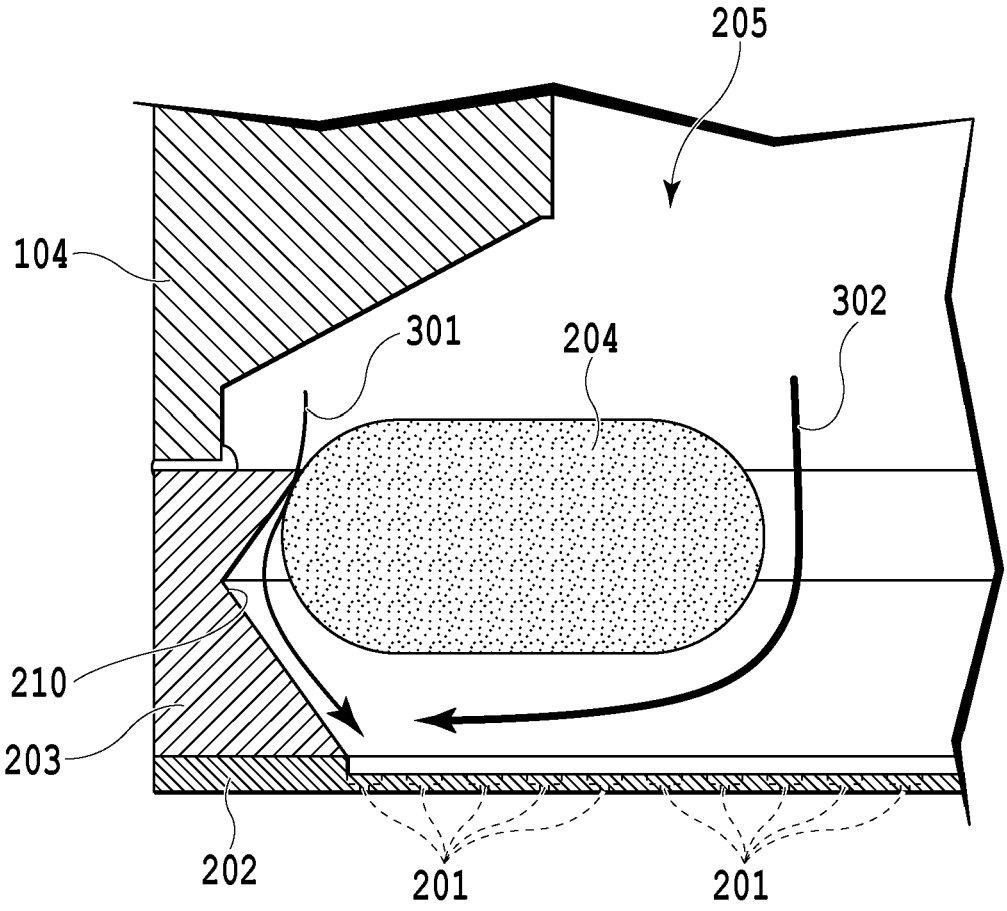
FIG. 5 is a cross sectional view showing V-V section in FIG. 4.

FIG. 3 is a cross sectional view showing III-III section in FIG. 2. In a case where the air bubble 204 is trapped near the central part of the liquid supply hole 210 as shown in FIG. 3, a flow speed of an ink flow 311 is substantially equal to that of an ink flow 312. On the other hand, FIG. 4 is a cross sectional view showing IV-IV section in FIG. 3, and III-III section and V-V section shown in FIG. 4 respectively correspond to III-III section and V-V section shown in FIG. 2. As the air bubble 204 in a V-V section position shown in FIG. 4, there are some cases where the air bubble is trapped closer to one end of the liquid supply hole 210 having a rectangular sectional configuration. FIG. 5 is a cross section showing V-V section of this case. As shown in FIG. 5, in a state where the air bubble 204 is trapped closer to one end of the liquid supply passage 210, a difference in flow resistance between an ink flow 301 and an ink flow 302 becomes large and a flow speed of the ink flow 302 increases. In some cases the flow speed of the ink flow 302 is approximately twice that of each of the ink flow 311 and the ink flow 312 that flow substantially equally at both the ends of the air bubble 204 shown in FIG. 3. In a case where ink ejection with a high drive frequency and a high duty is performed by this phenomenon, the flow speed of the ink flow 302 extremely increases. Therefore a liquid pressure under the air bubble 204 is lowered, and in some cases the air bubble 204 is pulled in to the ejection opening 201 side at the time of exceeding a certain flow speed.

Further, in a case of the liquid ejection head in one unit for three color inks as in the present example, as shown in FIG. 2 and FIG. 4 in many cases the liquid supply holes 210 are arranged in parallel to each other in the substrate 203. As a result, the configuration of the ink flow passage 205 connected to the central liquid supply hole 210 is lower in degree of freedom to the structure of each of the ink flow passages 205 positioned at both the sides, and therefore there is a tendency that a region in which the width of the ink flow passage 205 is narrow is long and a volume for receiving the air bubble 204 is small. For example, as shown in FIG. 5, in a case where the configuration of the ink flow passage 205 has the narrow and long region, there are some cases where at the time the air bubble 204 will move above the liquid supply hole 210, the support member 104 is present in a position of interrupting this movement. As a result, the air bubble 204 in the central liquid supply hole 210 and the ink flow passage 205 has a tendency of staying therein without moving to the ink storage portion side (not shown).

In FIG. 5, the flow speed of the ink flow 302 is in proportion to the number of ejection openings present under the air bubble 204, the drive frequency and the like, and in inverse proportion to a sectional area of the liquid supply passage under the air bubble 204 as a whole. Therefore as a length of the trapped air bubble 204 is longer (the volume is larger), the flow speed of the ink flow 302 is the faster. As the liquid supply hole 210 and the flow passage 205 in the support member is narrower, there is a tendency that the length of the trapped air bubble 204 is the longer, also increasing an occurrence rate of an ejection failure.

Hereinafter, an explanation will be made of embodiments of the present invention for solving the aforementioned problems due to air bubbles in the conventional technology.

First Embodiment

A liquid ejection head according to a first embodiment of the present invention is the same with that of the above-described embodiment in FIG. 1. The configuration of II-II section in FIG. 1 according to the present embodiment has, as similar to the configuration shown in FIG. 2, a liquid supply hole a section of which has a rhomboid configuration. An explanation will be primarily made of points different from the head structure shown in FIG. 2 to FIG. 5 in the following explanation.

Figure 6:
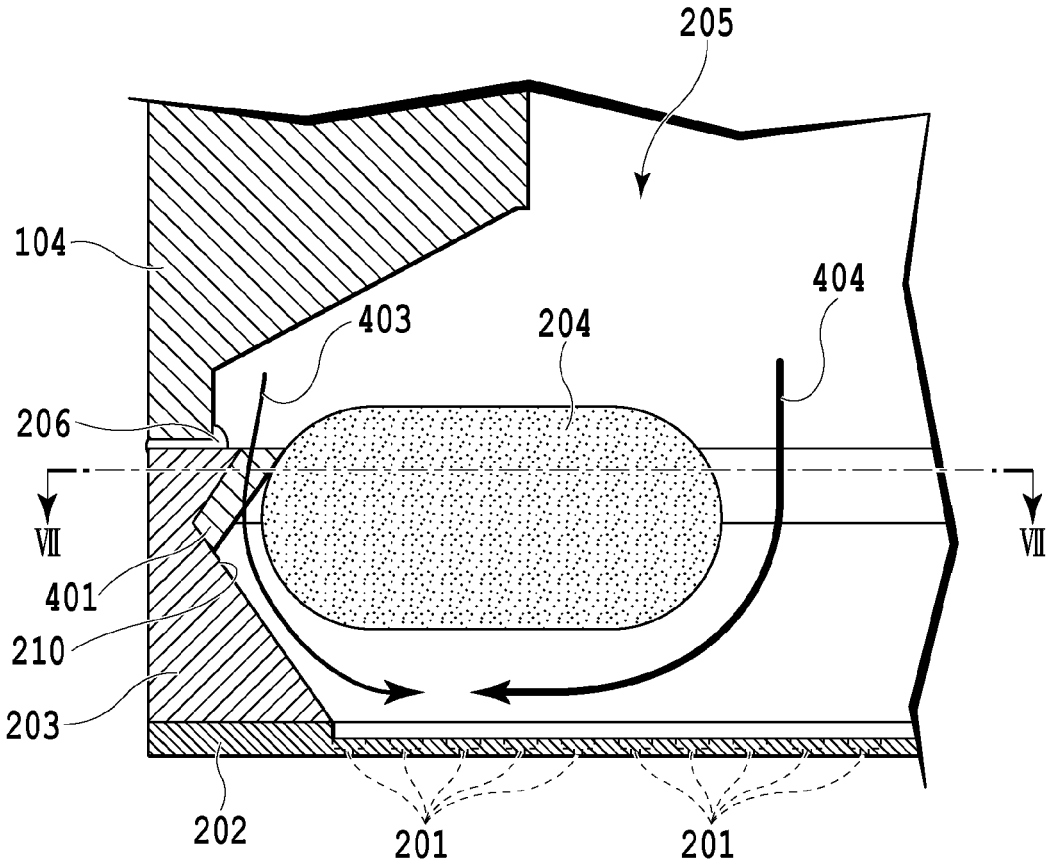
FIG. 6 is a cross sectional view showing the same cross section with V-V section in FIG. 2, according to a first embodiment in the present invention.
Figure 7:
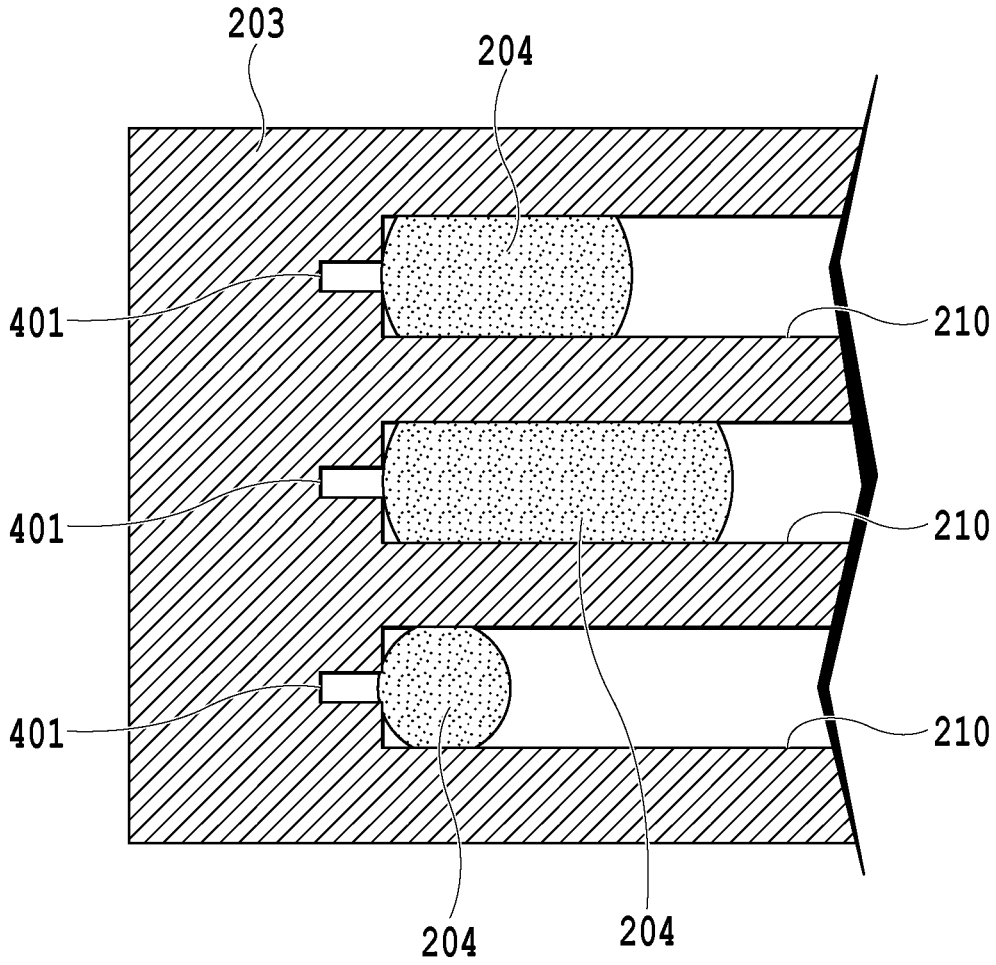
FIG. 7 is a cross sectional view showing VII-VII section in FIG. 6.

FIG. 6 is a cross sectional view showing a section in the same position with V-V section in FIG. 2 according to the present embodiment. In FIG. 6, the printing element substrate 101 is jointed to the support member 104, and the printing element substrate 101 includes the ejection opening forming member 202 that is a member provided with the ejection openings 201, and the substrate 203. The substrate 203 has a joint surface (first surface) to the ejection opening forming member 202 and a joint surface (second surface) to the support member 104, and has the liquid supply hole 210 that communicate the first surface with the second surface. FIG. 7 is a cross sectional view showing VII-VII section in FIG. 6. The liquid supply hole 210, as shown in FIG. 7, has an opening end in a rectangular shape on this cut plane. As shown in FIG. 6 and FIG. 7, recessed portions 401 are provided in both of shorter sides of the rectangular liquid supply hole 210 in the present embodiment. As shown in FIG. 6, the recessed portion 401 has a certain depth toward the ejection opening side. In addition, the recessed portion 401 extends in a direction along longer sides of the rectangular shape. It should be noted that the configuration of the liquid supply hole 210 on the joint surface jointed to the support member 104 in the substrate 203 is also substantially the same with the configuration in FIG. 7 that is a cross section showing VII-VII section as described above. That is, the recessed portions 401 are formed also on the joint surface of the substrate 203.

The above-mentioned structure of the recessed portion 401 makes it possible to ensure the flow path by the recessed portion, and therefore even when the air bubble 204 is trapped to be closer to and in contact to one end of the liquid supply hole 210, the ink flow 403 and the ink flow 404 generated in that state can reduce a difference in flow resistance thereto. In addition, the flow speed of the ink flow 404 in this case is smaller as compared to that of the ink flow 302 in the state in FIG. 5. In this way, the flow speeds of the inks flowing in the periphery of the air bubble 204 can be made small as a whole, resulting in suppressing occurrence of the ejection failure due to transfer of the air bubble 204 to the ejection opening side or the like.

In the present embodiment, etching by a crystal axis anisotropy etching method is performed to form the liquid supply hole 210. An etching section is selected by a mask provided on the joint surface of the substrate 203 for forming a rectangular opening shown in the cross section in FIG. 7. On this occasion, the recessed portion 401 with the liquid supply hole 210 having the rhomboid configuration in section can be formed. In addition, the recessed portion 401 is formed toward the ejection opening 201-side, and therefore does not bring any influence on pitches between the three liquid supply holes 210.

Figure 8:
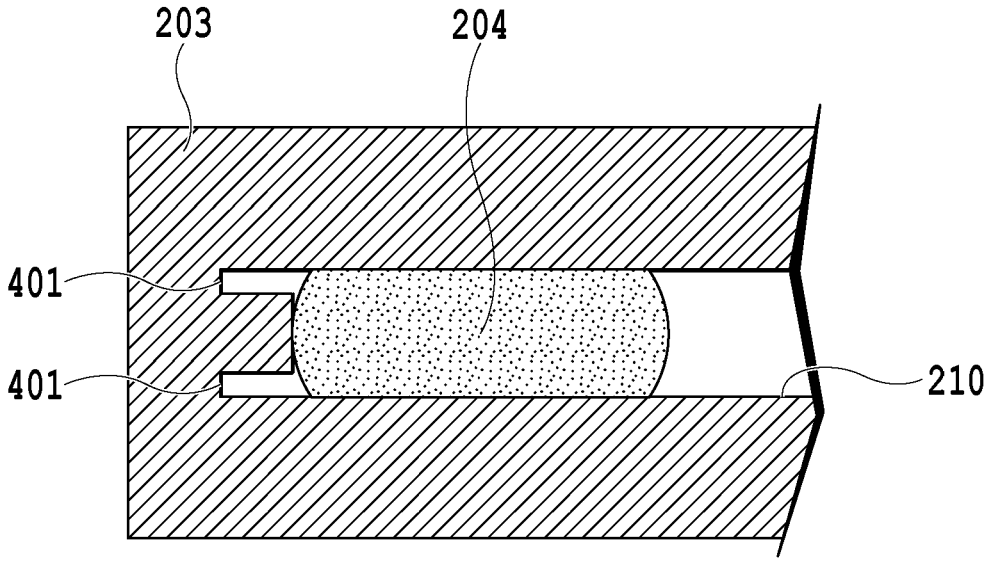
FIG. 8 is a cross sectional view showing a modification of a liquid supply passage according to the first embodiment in the present invention.

FIG. 8 is a cross sectional view showing a modification of the liquid supply hole 210 according to the present embodiment, and shows an example in which each of the liquid supply holes 210 is provided with two recessed portions 401. With this configuration, a sectional area of the flow path to be provided can be widened more than that of the recessed portion 401 shown in FIG. 7 to reduce the flow resistance to be smaller. The configuration thereof can be formed by the mask and the etching condition in the crystal axis anisotropy etching method. It should be noted that the number of the recessed portions is not limited to two, but may be three or more depending on a size of a section to be formed or the like.

Second Embodiment

Figure 9:
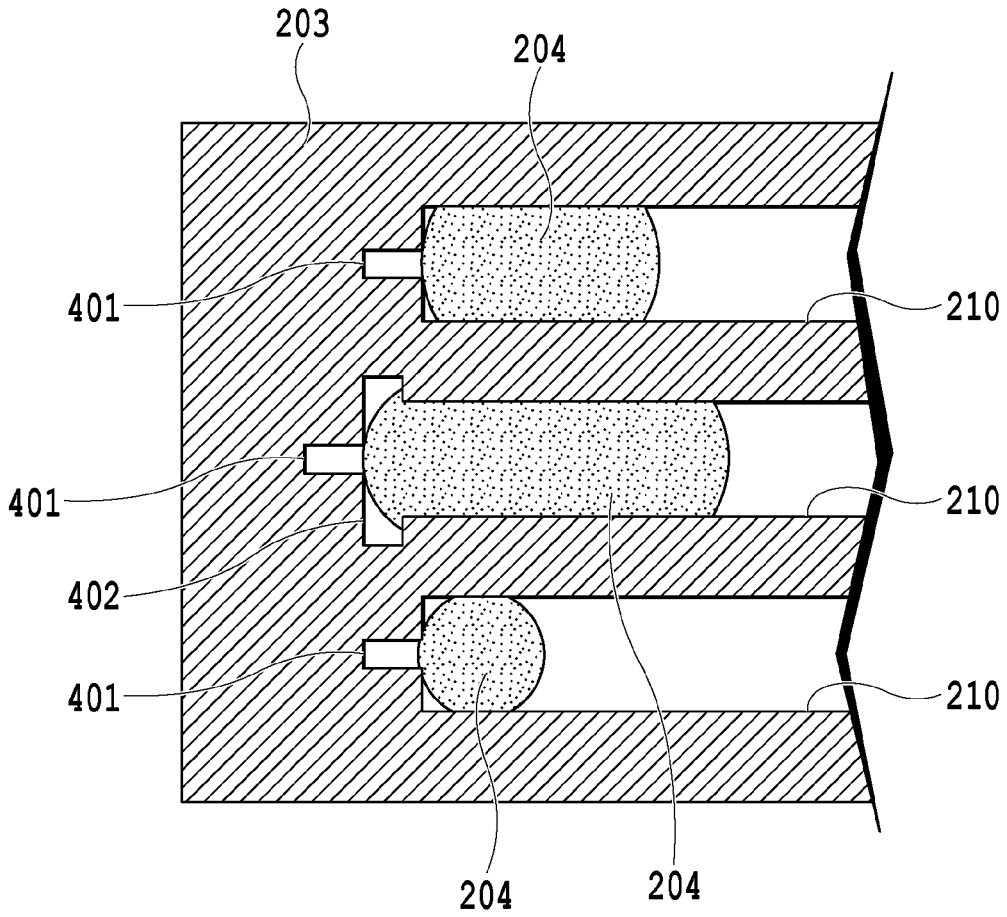
FIG. 9 is a cross sectional view showing a section in the same position with VII-VII section in FIG. 6, according to a second embodiment in the present invention.

A second embodiment in the present invention relates to the structure where recessed portion is formed along a shorter side direction of the rectangular shape of the liquid supply hole, in both ends of the liquid supply hole 210, in addition to the recessed portion 401 explained in the first embodiment. FIG. 9 is a cross sectional view showing a section in the same position with VII-VII section in FIG. 6, according to the present embodiment. As shown in FIG. 9, recessed portions 402 in addition to the recessed portion 401 are provided in both of the longitudinal ends of the central liquid supply hole 210 in three liquid supply holes to be formed along the shorter side direction of the rectangular shape of the liquid supply hole 210.

As described before by referring to FIG. 5, in a case of the liquid ejection head with the printing element substrate 203 having the liquid supply passages 210 for inks of three colors, the structure of the flow passage 205 in the support member 104 corresponding to the central liquid supply hole 210 has a tendency that the narrow flow path configuration is longer as compared to the flow passage structures at both the sides. Therefore the air bubble tends to be more easily retained in the central liquid supply hole 210 or flow passage 205. In addition, a length of the air bubble retained in the liquid supply hole 210 tends to be easily long.

On the other hand, in the present embodiment, the recessed portions 402 in addition to the recessed portion 401 are provided in both of the longitudinal ends of the central liquid supply hole 210 in the three liquid supply holes 210 to be disposed along the shorter side direction of the rectangular shape of the liquid supply hole. Therefore even when the air bubble 204 is retained to be in contact with the longitudinal end of the liquid supply passage 210, a sufficient flow amount of ink can be ensured. In addition, it is possible to avoid a state where a distance between the three liquid supply holes 210 is made small, and for example, an adherence area between the printing element substrate 101 and the support member 104 cannot be ensured, in a case where the recessed portions 402 are provided in all of the three liquid supply holes 210 to be disposed along the shorter side direction thereof.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-260518 filed Dec. 17, 2013, and No. 2014-222786 filed Oct. 31, 2014, which are hereby incorporated by reference wherein in their entirety.

What is claimed is:

1. A printing element substrate in which an ejection opening for ejecting a liquid is provided, wherein the printing element substrate is provided with a liquid supply passage that is formed along a direction from a surface of the substrate at the opposite to a surface thereof where the ejection opening is provided to the surface where the ejection opening is provided, the liquid supply passage being shaped such that an area of a cross section along a direction perpendicular to the direction to the surface where the ejection opening is provided increases and after that, decreases, in the direction to the surface where the ejection opening is provided, and the liquid supply passage has an opening end of a rectangular shape on the surface of the substrate at the opposite to the surface on the side where the ejection opening is provided, and a recessed portion, which has a certain depth in a direction toward the surface on the side where the ejection opening is provided, is formed on a shorter side in the rectangular shape, wherein a plurality of the recessed portions are provided on the shorter side in the rectangular shape.

2. The printing element substrate according to claim 1, wherein the recessed portion extends in a direction along a longer side of the rectangular shape.

3. A liquid ejection head comprising:

a printing element substrate in which an ejection opening for ejecting a liquid is provided, the printing element substrate being provided with a liquid supply passage that is formed along a direction from a surface of the substrate at the opposite to a surface thereof where the ejection opening is provided to the surface where the ejection opening is provided, and the liquid supply passage being shaped such that an area of a cross section along a direction perpendicular to the direction to the surface where the ejection opening is provided increases and after that, decreases, in the direction to the surface where the ejection opening is provided, wherein the liquid supply passage has an opening end of a rectangular shape on the surface of the substrate at the opposite to the surface on the side where the ejection opening is provided, and a recessed portion, which has a certain depth in a direction toward the surface on the side where the ejection opening is provided, is formed on a shorter side in the rectangular shape, wherein a plurality of the recessed portions are provided on the shorter side in the rectangular shape.

4. The liquid ejection head according to claim 3, wherein the recessed portion extends in a direction along a longer side of the rectangular shape.

5. An inkjet printing apparatus that uses a liquid ejection head for ejecting ink to perform printing, the liquid ejection head comprising:

a printing element substrate in which an ejection opening for ejecting a liquid is provided, the printing element substrate being provided with a liquid supply passage that is formed along a direction from a surface of the substrate at the opposite to a surface thereof where the ejection opening is provided to the surface where the ejection opening is provided, and the liquid supply passage being shaped such that an area of a cross section along a direction perpendicular to the direction to the surface where the ejection opening is provided increases and after that, decreases, in the direction to the surface where the ejection opening is provided, wherein the liquid supply passage has an opening end of a rectangular shape on the surface of the substrate at the opposite to the surface on the side where the ejection opening is provided, and a recessed portion, which has a certain depth in a direction toward the surface on the side where the ejection opening is provided, is formed on a shorter side in the rectangular shape, wherein a plurality of the recessed portions are provided on the shorter side in the rectangular shape.

6. A liquid ejection head comprising:

a member including an ejection opening array in which ejection openings are arranged for ejecting a liquid; and a substrate including a first surface jointed to the member, a second surface as a backside of the first surface, and a liquid supply passage that establishes communication between the first surface and the second surface, the liquid supply passage including a part in which an area of a cross-section surface along the second surface increases in a first direction directed from the second surface to the first surface and a part in which the area decreases in the first direction and extending in a second direction along the ejection opening array, wherein a recessed portion having a certain depth in the first direction is formed on an end in the second direction of an opening of the liquid supply passage on the second surface, and wherein a length of the recessed portion in a third direction perpendicular to the second direction is shorter than a length of the end of the opening in the third direction.

7. The liquid ejection head according to claim 6, wherein a length of the recessed portion in the second direction is longer than a length of recessed portion in a third direction perpendicular to the second direction.

8. The liquid ejection head according to claim 6, wherein the recessed portion is provided in the part in which the area of the cross-section surface of the liquid supply passage increases.

* * * * *